US011742557B2

(12) United States Patent
Kikuda

(10) Patent No.: US 11,742,557 B2
(45) Date of Patent: Aug. 29, 2023

(54) DIELECTRIC WAVEGUIDE FILTER

(71) Applicant: Murata Manufacturing Co., Ltd., Nagaokakyo (JP)

(72) Inventor: Masayuki Kikuda, Nagaokakyo (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 0 days.

(21) Appl. No.: 17/724,762

(22) Filed: Apr. 20, 2022

(65) Prior Publication Data

US 2022/0247056 A1 Aug. 4, 2022

Related U.S. Application Data

(63) Continuation of application No. PCT/JP2020/039853, filed on Oct. 23, 2020.

(30) Foreign Application Priority Data

Dec. 9, 2019 (JP) ..... 2019-222125

(51) Int. Cl.
*H01P 1/20* (2006.01)

(52) U.S. Cl.
CPC ..... *H01P 1/2002* (2013.01)

(58) Field of Classification Search
CPC ..... H01P 1/2002; H01P 1/20; H01P 1/207; H01P 1/208; H01P 1/2088; H01P 1/201; H01P 1/2084; H01P 1/2086; H01P 3/16; H01P 3/122; H01P 3/12; H01P 3/121; H01P 7/10; H01P 7/105
See application file for complete search history.

(56) References Cited

U.S. PATENT DOCUMENTS

| | | | |
|---|---|---|---|
| 5,608,363 A | 3/1997 | Cameron et al. | |
| 2005/0156688 A1 | 7/2005 | Ito et al. | |
| 2012/0169435 A1 | 7/2012 | Kaneda et al. | |
| 2022/0285810 A1* | 9/2022 | Manzoni | H01P 1/2088 |

FOREIGN PATENT DOCUMENTS

| | | |
|---|---|---|
| JP | 2000-082903 A | 3/2000 |
| JP | 2003-229703 A | 8/2003 |
| JP | 2008-098727 A | 4/2008 |
| WO | 95/27317 A1 | 10/1995 |
| WO | 2018/012294 A1 | 1/2018 |

OTHER PUBLICATIONS

Official Communication issued in International Patent Application No. PCT/JP2020/039853, dated Dec. 28, 2020.

* cited by examiner

*Primary Examiner* — Stephen E. Jones
(74) *Attorney, Agent, or Firm* — KEATING & BENNETT, LLP

(57) ABSTRACT

A dielectric waveguide filter includes resonators in a dielectric plate. A main coupling portion is between a final stage resonator of a first set and an initial stage resonator of a second set. A trap resonator is between a resonator that is one stage before the final stage resonator of the first set and a resonator that is one stage after the initial stage resonator of the second set, and the trap resonator is coupled to the final stage resonator of the first set and the initial stage resonator of the second set.

26 Claims, 13 Drawing Sheets

DIELECTRIC WAVEGUIDE FILTER

CROSS REFERENCE TO RELATED APPLICATIONS

This application claims the benefit of priority to Japanese Patent Application No. 2019-222125 filed on Dec. 9, 2019 and is a Continuation Application of PCT Application No. PCT/JP2020/039853 filed on Oct. 23, 2020. The entire contents of each application are hereby incorporated herein by reference.

BACKGROUND OF THE INVENTION

1. Field of the Invention

The present invention relates to a dielectric waveguide filter that includes a plurality of dielectric waveguide resonators.

2. Description of the Related Art

An example of a dielectric waveguide filter that includes a plurality of dielectric waveguide resonators is disclosed in International Publication No. 2018/012294. In the dielectric waveguide filter described in International Publication No. 2018/012294, coupling portions are provided between the dielectric waveguide resonators in such a manner that an adjacent pair of the resonators are coupled to each other by each of the coupling portions.

In a dielectric waveguide filter, such as that disclosed in International Publication No. 2018/012294, in which a plurality of dielectric waveguide resonators are arranged such that adjacent ones of the dielectric waveguide resonators are coupled to each other, the dielectric waveguide resonators that are adjacent to each other along a main path of signal propagation are coupled to each other, and an auxiliary path that couples two of the plurality of dielectric waveguide resonators, which are arranged along the main path, by skipping at least one of the plurality of dielectric waveguide resonators can be formed.

SUMMARY OF THE INVENTION

In the related art, in order to ensure attenuation on the low frequency side and the high frequency side of a pass band, a plurality of dielectric waveguide resonators are connected in a necessary number of stages. In addition, an auxiliary path is provided separately from a main path of signal propagation so as to couple certain dielectric waveguide resonators by so-called "cross-coupling", and an attenuation pole is generated on the low frequency side or the high frequency side of the pass band.

However, as the number of stages of resonators increases in order to ensure a predetermined amount of attenuation, the insertion loss in the pass band becomes large. In addition, the entire size increases.

Preferred embodiments of the present invention provide dielectric waveguide filters with steep attenuation characteristics from a pass band to an attenuation band. Configurations of dielectric waveguide filters according to example embodiments of the present disclosure may be enumerated as follows.

A dielectric waveguide filter includes a plurality of dielectric waveguide resonators, a main coupling portion, and an auxiliary coupling portion.

Each of the dielectric waveguide resonators includes a dielectric plate including a first main surface, a second main surface, and a side surface, the first main surface and the second main surface opposing each other, and the side surface connecting an outer edge of the first main surface and an outer edge of the second main surface to each other, a first surface conductor in or on the first main surface, a second surface conductor in or on the second main surface, and a connection conductor in the dielectric plate and connecting the first surface conductor and the second surface conductor to each other.

The main coupling portion is between dielectric waveguide resonators that are adjacent to each other along a main path of signal propagation, and the auxiliary coupling portion is between dielectric waveguide resonators that are adjacent to each other along an auxiliary path of signal propagation.

Some or all of the plurality of dielectric waveguide resonators each include an inner conductor that extends in a direction perpendicular to the first main surface.

The plurality of dielectric waveguide resonators include a first set of dielectric waveguide resonators including three or more dielectric waveguide resonators, a second set of dielectric waveguide resonators including three or more dielectric waveguide resonators, and a dielectric waveguide resonator for a trap resonator that includes the inner conductor.

The main coupling portion is provided between the dielectric waveguide resonator in a final stage of the first set and the dielectric waveguide resonator in an initial stage of the second set.

The dielectric waveguide resonator for a trap resonator is between the dielectric waveguide resonator that is one stage before the dielectric waveguide resonator in the final stage of the first set and the dielectric waveguide resonator that is one stage after the dielectric waveguide resonator in the initial stage of the second set.

The dielectric waveguide resonator for a trap resonator is a dielectric waveguide resonator that is coupled to the dielectric waveguide resonator in the final stage of the first set and the dielectric waveguide resonator in the initial stage of the second set.

In addition, configurations of dielectric waveguide filters according to other example embodiments of the present disclosure may be enumerated as follows.

A dielectric waveguide filter includes a plurality of dielectric waveguide resonators, a main coupling portion, and an auxiliary coupling portion.

Each of the dielectric waveguide resonators includes a dielectric plate including a first main surface, a second main surface, and a side surface, the first main surface and the second main surface opposing each other, and the side surface connecting an outer edge of the first main surface and an outer edge of the second main surface to each other, a first surface conductor that in or on the first main surface, a second surface conductor in or on the second main surface, and a connection conductor in the dielectric plate and connecting the first surface conductor and the second surface conductor to each other.

The main coupling portion is between dielectric waveguide resonators that are adjacent to each other along a main path of signal propagation, and the auxiliary coupling portion is between dielectric waveguide resonators that are adjacent to each other along an auxiliary path of signal propagation.

Some or all of the plurality of dielectric waveguide resonators each include an inner conductor that extends in a direction perpendicular to the first main surface.

The plurality of dielectric waveguide resonators include a first set of dielectric waveguide resonators including three or more dielectric waveguide resonators, a second set of dielectric waveguide resonators including three or more dielectric waveguide resonators, and a dielectric waveguide resonator for a trap resonator that includes the inner conductor.

The main coupling portion is provided between the dielectric waveguide resonator in a final stage of the first set and the dielectric waveguide resonator in an initial stage of the second set.

The dielectric waveguide resonator for a trap resonator is at a position surrounded by the inner conductor of the dielectric waveguide resonator in the final stage of the first set, the inner conductor of the dielectric waveguide resonator in the initial stage of the second set, the inner conductor of the dielectric waveguide resonator that is one stage before the dielectric waveguide resonator in the final stage of the first set, and the inner conductor of the dielectric waveguide resonator that is one stage after the dielectric waveguide resonator in the initial stage of the second set.

The dielectric waveguide resonator for a trap resonator is a dielectric waveguide resonator that is coupled to the dielectric waveguide resonator in the final stage of the first set and the dielectric waveguide resonator in the initial stage of the second set.

According to the dielectric waveguide filter including the above configuration, attenuation characteristics from a pass band to an attenuation band are improved by operation of the dielectric waveguide resonator for a trap resonator. Accordingly, the number of stages of dielectric waveguide resonators can be reduced, and thus, the insertion loss can be reduced.

According to example preferred embodiments of the present invention, dielectric waveguide filters each achieving steep attenuation characteristics from a pass band to an attenuation band with a small number of stages of resonators are provided.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
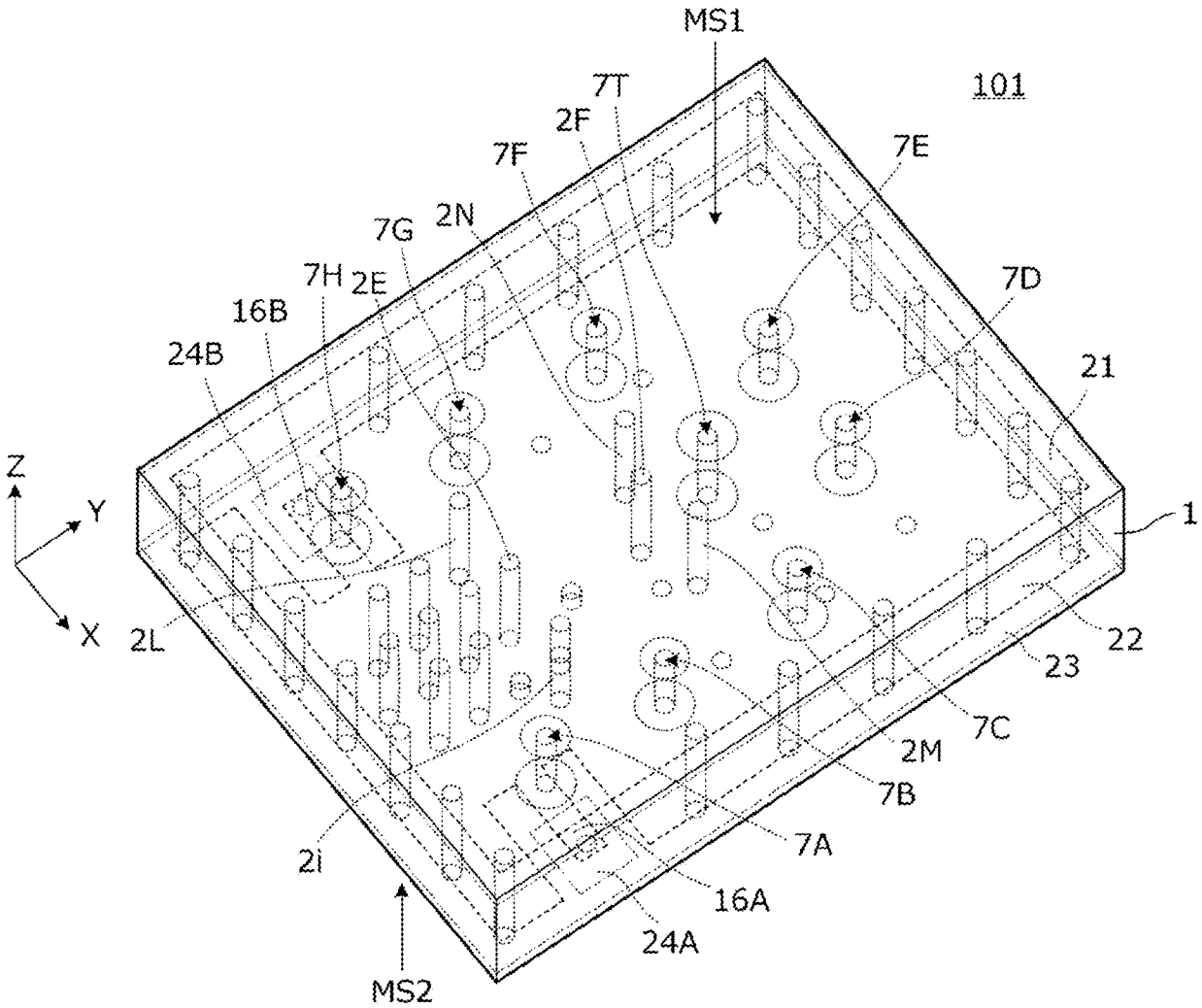
FIG. 1 is a perspective view illustrating an internal structure of a dielectric waveguide filter 101 according to a first preferred embodiment of the present invention.

A plurality of preferred embodiments of the present invention will be described below using some specific examples with reference to the drawings. In the drawings, the same members are denoted by the same reference signs. Although the preferred embodiments will be separately described for ease of explaining and understanding the gist of the present invention, the configurations according to the different preferred embodiments may be partially replaced with one another or may be combined with one another. In the second preferred embodiment and the subsequent preferred embodiments, descriptions of matters that are common to the first preferred embodiment will be omitted, and only differences will be described. In particular, similar advantageous effects obtained with similar configurations will not be described in every preferred embodiment.

First Preferred Embodiment

Figure 2:
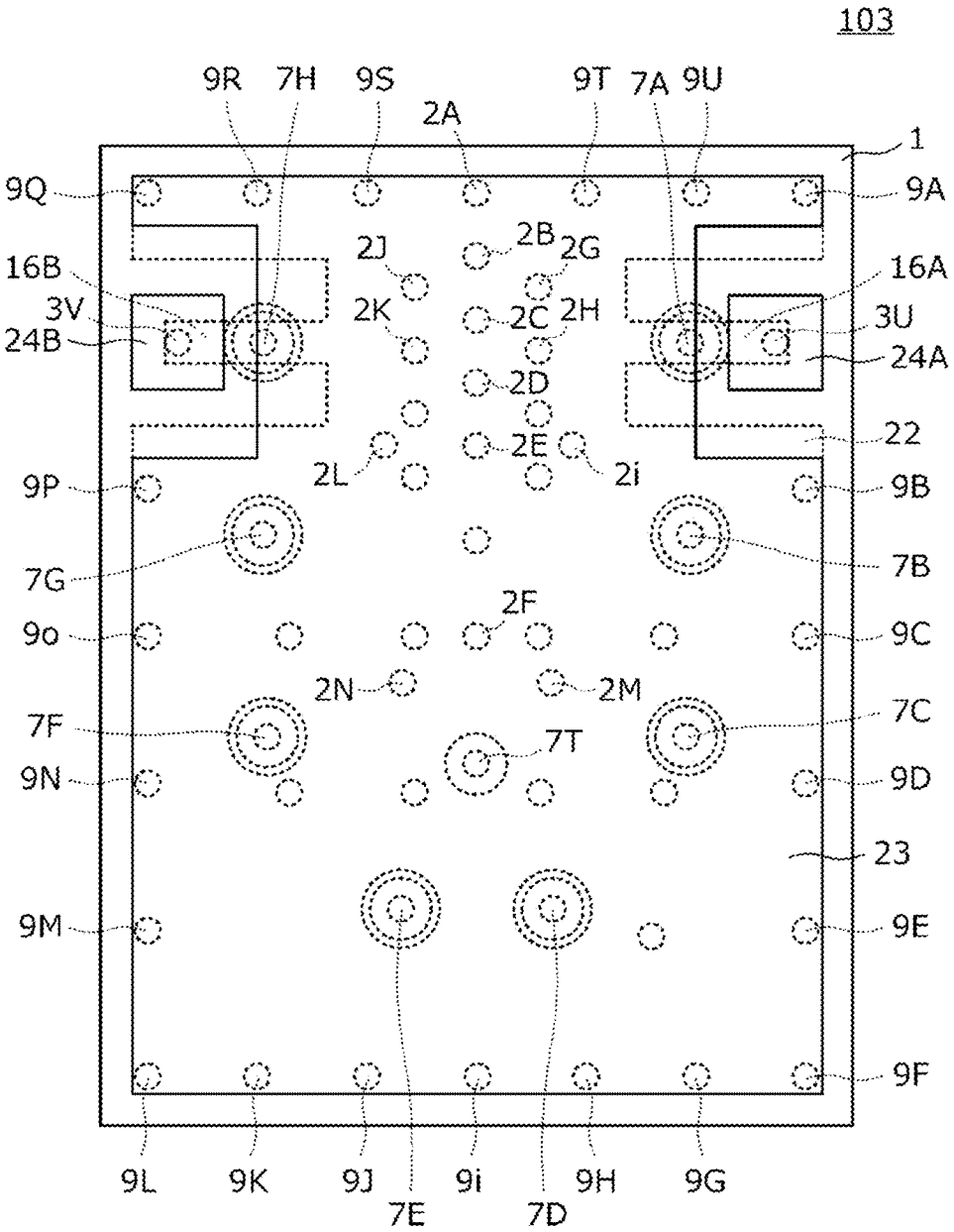
FIG. 2 is a bottom view of the dielectric waveguide filter 101.
Figure 3:
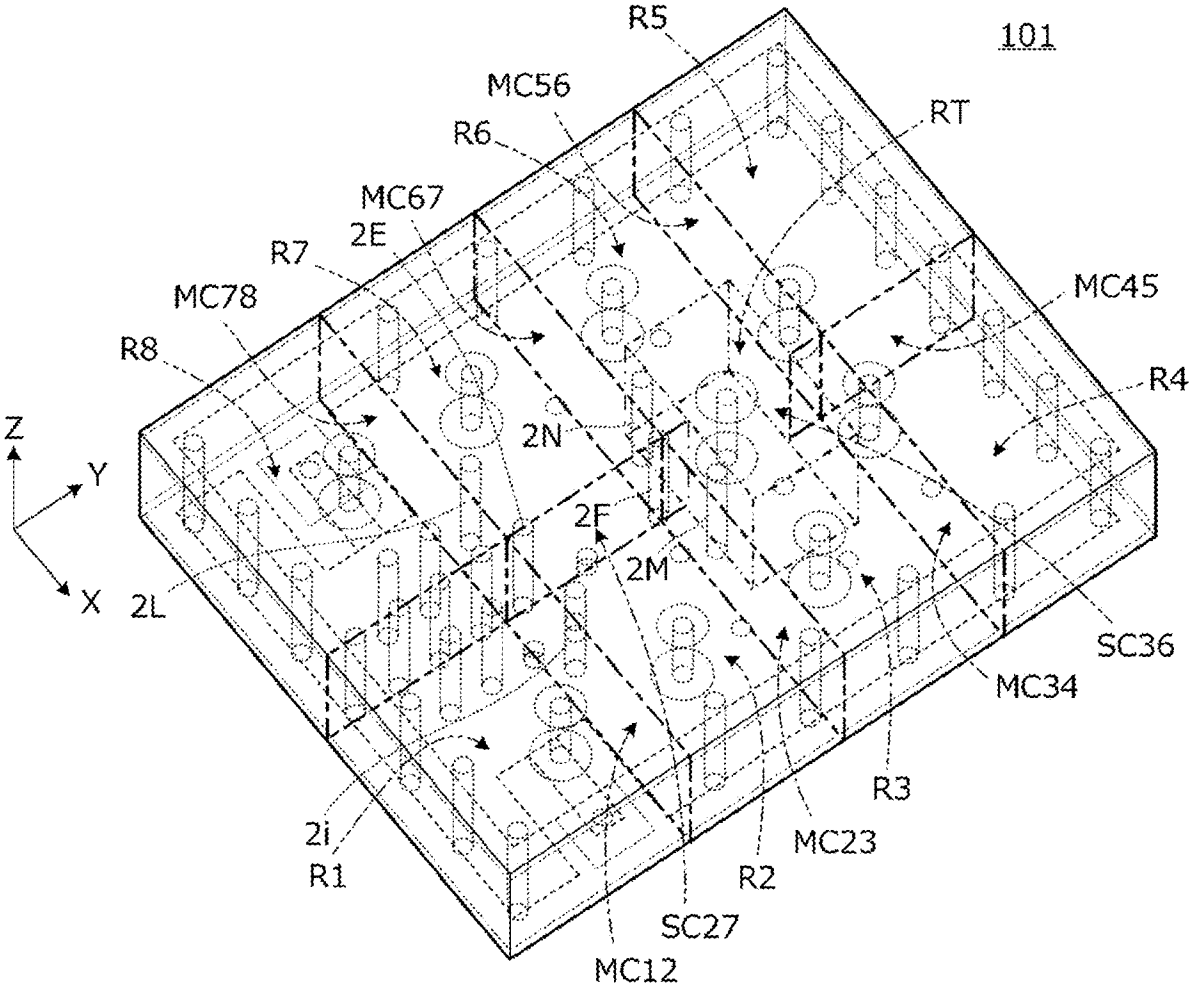
FIG. 3 is a perspective view illustrating nine dielectric waveguide resonator portions, main coupling portions, and auxiliary coupling portions that are included in the dielectric waveguide filter 101, the main coupling portions and the auxiliary coupling portions being provided between dielectric waveguide resonators.

FIG. 1 is a perspective view illustrating the internal structure of a dielectric waveguide filter 101 according to the first preferred embodiment. FIG. 2 is a bottom view of the dielectric waveguide filter 101. FIG. 3 is a perspective view illustrating nine dielectric waveguide resonator portions, main coupling portions, and auxiliary coupling portions that are included in the dielectric waveguide filter 101, the main coupling portions and the auxiliary coupling portions being provided between dielectric waveguide resonators.

The dielectric waveguide filter 101 includes a dielectric plate 1. The dielectric plate 1 is formed by, for example, processing a dielectric ceramic, a quartz crystal, a resin, or the like into a rectangular parallelepiped shape. The dielectric plate 1 includes a first main surface MS1 and a second main surface MS2, which are opposite to each other, and four side surfaces SS, which connect the outer edge of the first main surface MS1 and the outer edge of the second main surface MS2 to each other. In this case, the size of the dielectric waveguide filter 101 in the X direction is about 2.5 mm, for example. The size of the dielectric waveguide filter 101 in the Y direction is about 3.2 mm, for example. The size of the dielectric waveguide filter 101 in the Z direction is about 0.7 mm, for example.

A first surface conductor 21 is located in or on a layer of the dielectric plate 1 that is closer to the first main surface MS1, and a second surface conductor 22 is located in or on a layer of the dielectric plate 1 that is closer to the second main surface MS2.

Input and output electrodes 24A and 24B and a ground electrode 23 are located on the bottom surface of the dielectric plate 1. In the dielectric plate 1, strip conductors 16A and 16B are provided and respectively connected to the input and output electrodes 24A and 24B by via conductors 3U and 3V. In addition, a plurality of via conductors that connect the ground electrode 23 to the second surface conductor 22 are located in the vicinity of the bottom surface of the dielectric plate 1.

Through-via conductors 2A to 2N extend from the first surface conductor 21 to the second surface conductor 22 by extending through the dielectric plate 1.

In addition, in the dielectric plate 1, through-via conductors 9A to 9U that connect the first surface conductor 21 and the second surface conductor 22 to each other are located along the side surfaces of the dielectric plate 1.

As illustrated in FIG. 2, FIG. 3, and the like, the dielectric waveguide filter 101 has eight dielectric waveguide resonant spaces that are provided by being surrounded by the first surface conductor 21, the second surface conductor 22, and the through-via conductors 9A to 9U. In addition, another dielectric waveguide resonant space for a trap resonator is provided. In FIG. 3, two-dot chain lines are imaginary lines that partition the dielectric waveguide resonators in the dielectric plate 1 from one another. As described above, the dielectric waveguide filter 101 includes eight dielectric waveguide resonators R1, R2, R3, R4, R5, R6, R7, and R8 and a dielectric waveguide resonator RT for a trap resonator. Each of the resonators R1, R2, R3, R4, R5, R6, R7, R8, and RT is a resonator whose fundamental mode is a TE101 mode.

Each of the "dielectric waveguide resonators" will hereinafter also simply referred to as a "resonator". In other words, it is a resonant mode of electromagnetic field distribution in which the Z direction illustrated in FIG. 3 corresponds to an electric field direction and in which a magnetic field rotates in a plane direction along an XY plane. A peak of an electric field strength occurs in the X direction, and a peak of an electric field strength occurs in the Y direction.

When viewed in plan view (when viewed in the Z direction), inner conductors 7A to 7H and 7T that are illustrated in FIG. 1, FIG. 2, and the like are arranged in the above-mentioned dielectric waveguide resonant spaces. These inner conductors 7A to 7H and 7T extend in a direction perpendicular to the first main surface MS1 and are not electrically connected to either of the first surface conductor 21 and the second surface conductor 22. Thus, a local capacitance is generated between the inner conductors 7A to 7H and 7T and the first surface conductor 21 and between the inner conductors 7A to 7H and 7T and the second surface conductor 22. This can also be said that the inner conductors 7A to 7H and 7T partially narrow the distances between the dielectric waveguide resonant spaces in the electric field direction (the Z direction).

The above-mentioned local capacitances generated by the above-mentioned inner conductors 7A to 7H and 7T enable adjustment of the resonant frequencies of the resonators R1 to R8 and RT. In addition, the capacitance components of the dielectric waveguide resonant spaces increase, and thus, the size of each of the dielectric waveguide resonators for obtaining a predetermined resonant frequency can be reduced.

Among the above-mentioned resonators R1 to R8, the four resonators R1 to R4 is a first set of resonators, and the four resonators R5 to R8 is a second set of resonators. A main coupling portion MC45 is provided between the resonator R4 in the final stage of the first set and the resonator R5 in the initial stage of the second set. In addition, the resonator R1 in the initial stage of the first set and the resonator R8 in the final stage of the second set are resonators of an input/output section.

A main coupling portion MC12 is located between the resonators R1 and R2. A main coupling portion MC23 is located between the resonators R2 and R3. A main coupling portion MC34 is located between the resonators R3 and R4. In other words, in the first set of resonators, the four resonators R1 to R4 are connected in series by the main coupling portions. The main coupling portion MC45 is located between the resonators R4 and R5. A main coupling portion MC56 is located between the resonators R5 and R6. A main coupling portion MC67 is located between the resonators R6 and R7. A main coupling portion MC78 is located between the resonators R7 and R8. In other words, in the second set of resonators, the four resonators R5 to R8 are connected in series by the main coupling portions. In addition, an auxiliary coupling portion SC27 is located between the resonators R2 and R7, and an auxiliary coupling portion SC36 is located between the resonators R3 and R6.

A through-via conductor 2*i* that is illustrated in FIG. 2 narrows an opening of the main coupling portion MC12 in a transverse direction and inductively couples the resonator R1 and the resonator R2 to each other. Similarly, a through-via conductor 2L narrows an opening of the main coupling portion MC78 in the transverse direction and inductively couples the resonator R7 and the resonator R8 to each other. In addition, a through-via conductor 2M narrows an opening of the main coupling portion MC23 in the transverse direction and inductively couples the resonator R2 and the resonator R3 to each other. Similarly, a through-via conductor 2N narrows an opening of the main coupling portion MC67 in the transverse direction and inductively couples the resonator R6 and the resonator R7 to each other. Through-via conductors 2E and 2F narrow an opening of the auxiliary coupling portion SC27 in the transverse direction and inductively couples the resonator R2 and the resonator R7 to each other. In other words, the auxiliary coupling portion SC27 is provided between the resonator R2 that is two stages before the resonator R4 in the final stage of the first set and the resonator R7 that is two stages after the resonator R5 in the initial stage of the second set, and the auxiliary coupling portion SC27 is an inductive auxiliary coupling portion.

In addition, the inner conductor 7T narrow an opening of the auxiliary coupling portion SC36 and capacitively couples the resonator R3 and the resonator R6 to each other.

Regarding the main coupling portions MC34, MC45, and MC56, although there are no through vias that narrow openings of the main coupling portions MC34, MC45, and MC56 in the transverse direction, inductive coupling occurs in each of the main coupling portions MC34, MC45, and MC56 due to the relationship between the sizes of the resonant spaces defined by the first surface conductor 21, the second surface conductor 22, and the through-via conductors 9A to 9U and a resonant frequency that is used.

The space in which the inner conductor 7T is located defines and functions as the trap resonator RT. The trap resonator RT is provided between the resonator R3 that is one stage before the resonator R4 in the final stage of the first set and the resonator R6 that is one stage after the resonator R5 in the initial stage of the second set.

In addition, the trap resonator RT is provided at a position surrounded by the inner conductor 7D of the resonator R4 in the final stage of the first set, the inner conductor 7E of the resonator R5 in the initial stage of the second set, the inner conductor 7C of the resonator R3 that is one stage before the resonator R4 in the final stage of the first set, and the inner conductor 7F of the resonator R6 that is one stage after the resonator R5 in the initial stage of the second set.

The distance between the inner conductor 7D of the resonator R4 in the final stage of the first set and the inner conductor 7E of the resonator R5 in the initial stage of the second set is smaller than the distance between the inner conductor 7C of the resonator R3 that is one stage before the resonator R4 in the final stage of the first set and the inner conductor 7F of the resonator R6 that is one stage after the resonator R5 in the initial stage of the second set. As a result, regions of the resonators R4, R5, and RT each of which has a high electric field strength are close to one another, and the trap resonator RT is coupled to the resonators R4 and R5. This can also be said that the trap resonator RT is a resonator that branches off from the resonators R4 and R5.

In the present preferred embodiment, the distance between the inner conductor 7D of the resonator R4 in the final stage of the first set and the inner conductor 7T for a trap resonator is the same as the distance between the inner conductor 7E of the resonator R5 in the initial stage of the second set and the inner conductor 7T for a trap resonator. Thus, the coupling strength between the trap resonator RT and the resonator R4 and the coupling strength between the trap resonator RT and the resonator R5 are equal to each other.

Note that the inner conductors 7C and 7T are spaced apart from each other, and the inner conductors 7F and 7T are spaced apart from each other. In other words, regions of the resonators R3 and R6 and a region of the trap resonator RT, each of the regions including a high electric field strength, are relatively spaced apart from one another, and thus, the resonators R3 and R6 are not particularly coupled to the trap resonator RT.

Figure 4:
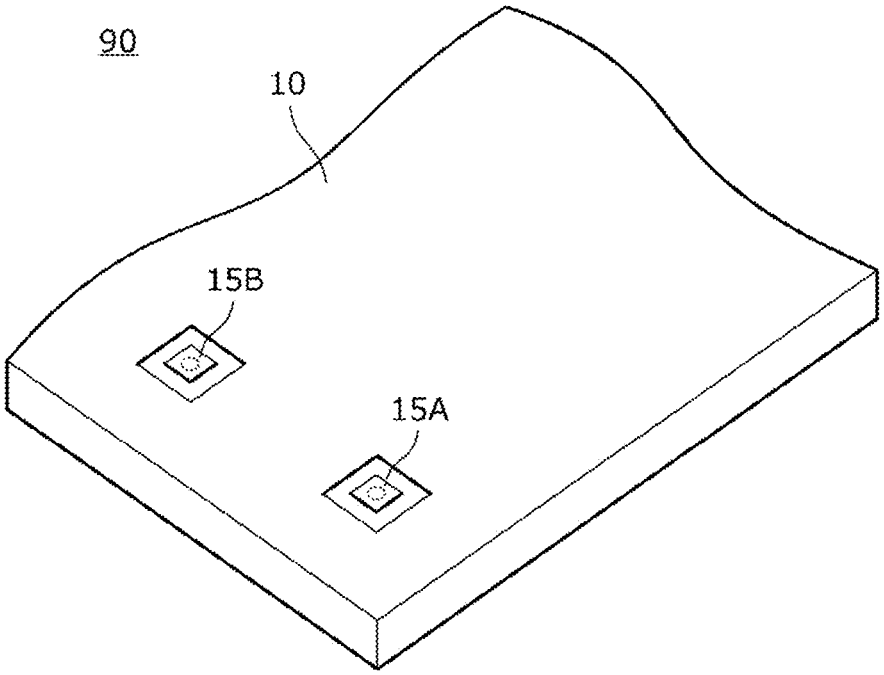
FIG. 4 is a partial perspective view of a circuit board 90 onto which the dielectric waveguide filter 101 is mounted.

FIG. 4 is a partial perspective view of a circuit board 90 onto which the dielectric waveguide filter 101 is mounted. The circuit board 90 includes a ground conductor 10 and input and output lands 15A and 15B. In a state where the dielectric waveguide filter 101 is surface-mounted on the circuit board 90, the input and output electrodes 24A and 24B of the dielectric waveguide filter 101 are connected to the above-mentioned input and output lands 15A and 15B, and the ground electrode 23 that is located on the bottom surface of the dielectric waveguide filter 101 is connected to the ground conductor 10 of the circuit board 90.

The circuit board 90 includes a transmission line such as a strip line, a microstrip line, or a coplanar line, that is connected to the above-mentioned input and output lands 15A and 15B.

A signal in a TEM mode propagates to the strip conductors 16A and 16B in the dielectric plate 1 illustrated in FIG. 1 and the like, and an electromagnetic field in the TEM mode and an electromagnetic field in the TE101 mode of the resonators R1 and R8 are coupled to each other and mode-converted.

Figure 5A:
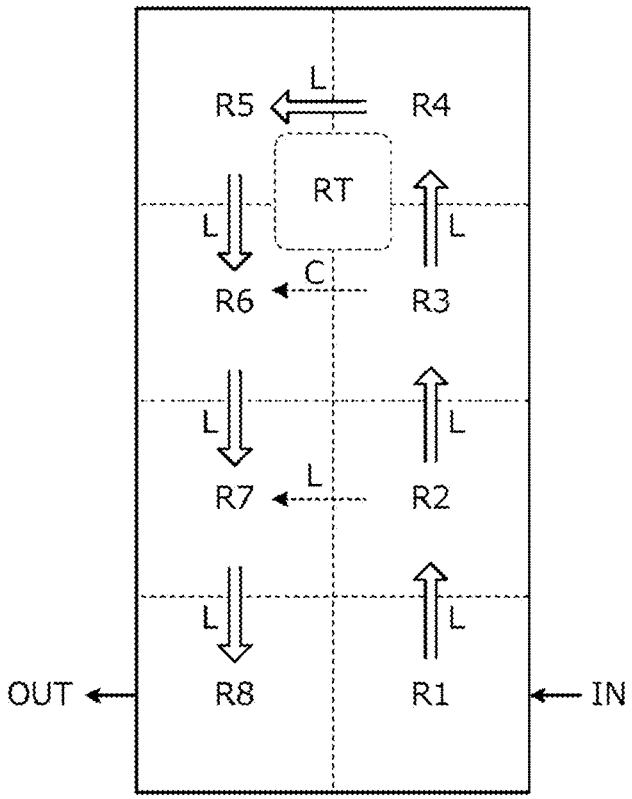
FIGS. 5A and 5B are diagrams illustrating a coupling structure of a plurality of resonators that are included in the dielectric waveguide filter 101 of the first preferred embodiment of the present invention.
Figure 5B:
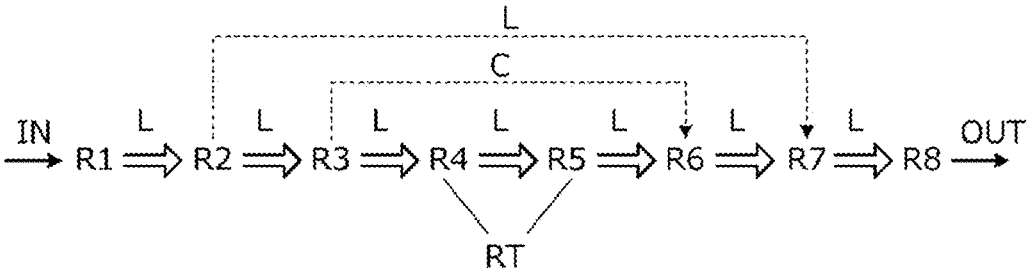

FIGS. 5A and 5B are diagrams illustrating a coupling structure of the plurality of resonators that are included in the dielectric waveguide filter 101 of the present preferred embodiment. In FIGS. 5A and 5B, the resonator R1 is the first stage (the initial stage) resonator. The resonator R2 is the second stage resonator. The resonator R3 is the third stage resonator. The resonator R4 is the fourth stage resonator. The resonator R5 is the fifth stage resonator. The resonator R6 is the sixth stage resonator. The resonator R7 is the seventh stage resonator. The resonator R8 is the eighth stage (the final stage) resonator. In FIGS. 5A and 5B, paths that are indicated by double lines are the main coupling portions, and dashed lines indicate the auxiliary coupling portions. In addition, in FIGS. 5A and 5B, the letter "L" denotes inductive coupling, and the letter "C" denotes capacitive coupling.

As mentioned above, in the dielectric waveguide filter 101 of the present preferred embodiment, the resonators R1, R2, R3, R4, R5, R6, R7, and R8 and the main coupling portion MC12, MC23, MC34, MC45, MC56, MC67, and MC78 are arranged along a main path of signal propagation. Each of the main coupling portion MC12, MC23, MC34, MC45, MC56, MC67, and MC78 is an inductive coupling portion. In addition, the auxiliary coupling portion SC27 is an inductive coupling portion, and the auxiliary coupling portion SC36 is a capacitive coupling portion. The coupling of the auxiliary coupling portion SC27 is weaker than the coupling of each of the main coupling portion MC12, MC23, MC34, MC45, MC56, MC67, and MC78. In addition, the coupling of the auxiliary coupling portion SC36 is weaker than the coupling of each of the main coupling portion MC12, MC23, MC34, MC45, MC56, MC67, and MC78.

Figure 6:
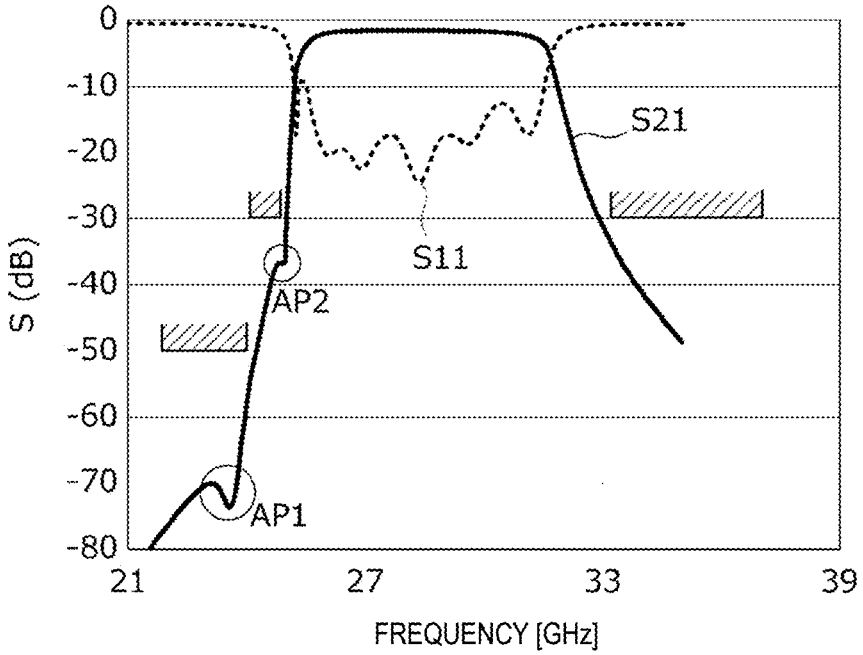
FIG. 6 is a graph illustrating frequency characteristics of a reflection characteristic and a bandpass characteristic of the dielectric waveguide filter 101.

FIG. 6 is a graph illustrating frequency characteristics of a reflection characteristic and a bandpass characteristic of the dielectric waveguide filter 101. In FIG. 6, S11 denotes the reflection characteristic, and S21 denotes the bandpass characteristic. As illustrated in FIG. 6, the dielectric waveguide filter 101 of the present preferred embodiment exhibits band-pass filter characteristics for a bandwidth of 28 GHz centered on 28 GHz. In addition, attenuation poles AP1 and AP2 are generated on the lower frequency side of a pass band. In the present preferred embodiment, steep attenuation characteristics are obtained on the low frequency side of the pass band.

The reason why such polar characteristics are exhibited is as follows.

First, regarding the transmission phase of a resonator, the phase is delayed by 90 degrees in a frequency range lower than a resonance frequency of the resonator, and the phase advances by 90 degrees in a frequency range higher than the resonant frequency. Inductive coupling and capacitive coupling have a phase inversion relationship, and thus, in the case of combining inductive coupling and capacitive coupling, there is a frequency at which a signal that is transmitted through a main coupling portion and a signal that is transmitted through an auxiliary coupling portions have opposite phases and the same amplitude. An attenuation pole appears at this frequency. In the dielectric waveguide filter 101 of the present preferred embodiment, the third resonator R3 and the fourth resonator R4 are inductively coupled to each other. The fourth resonator R4 and the fifth resonator R5 are inductively coupled to each other. The fifth resonator R5 and the sixth resonator R6 are inductively coupled to each other. Capacitive auxiliary coupling between the third resonator R3 and the sixth resonator R6 is obtained by skipping the fourth resonator R4 and the fifth resonator R5

(by skipping an even number of stages). Thus, the phases in the main coupling portions from the third resonator R3 to the sixth resonator R6 and the phase of the auxiliary coupling portion from the third resonator R3 to the sixth resonator R6 are inverted in a frequency range lower than the pass band. In other words, an attenuation pole appears in the frequency range lower than the pass band. This attenuation pole corresponds to the attenuation pole AP1 in FIG. 6.

In addition, the attenuation pole AP2 generated in the attenuation band on the low frequency side of the pass band is an attenuation pole that is generated by the dielectric waveguide resonator RT for a trap resonator. Here, the configurations and the characteristics of dielectric waveguide filters each of which is a comparative example will be described.

Figure 12:
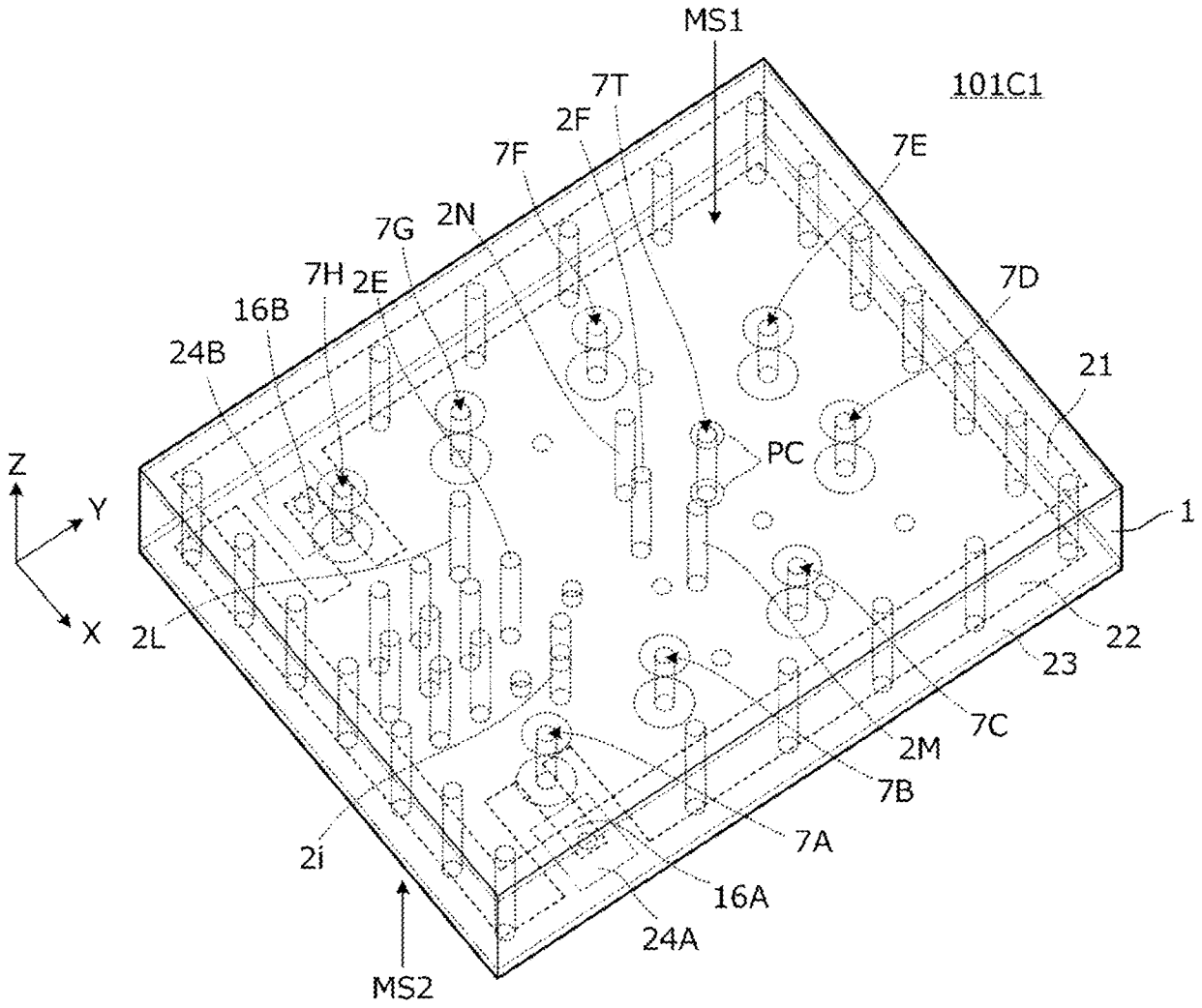
FIG. 12 is a perspective view illustrating an internal structure of a dielectric waveguide filter 101C1 that is a first comparative example.

FIG. 12 is a perspective view illustrating an internal structure of a dielectric waveguide filter 101C1 that is the first comparative example. The difference from the case illustrated in FIG. 1 is the size of the inner conductor 7T included in the dielectric waveguide resonator for a trap resonator. In the dielectric waveguide filter 101C1, the sizes of planar conductors PC of the inner conductor 7T are smaller than the sizes of the planar conductors PC of the inner conductor 7T of the dielectric waveguide filter 101.

Figure 14:
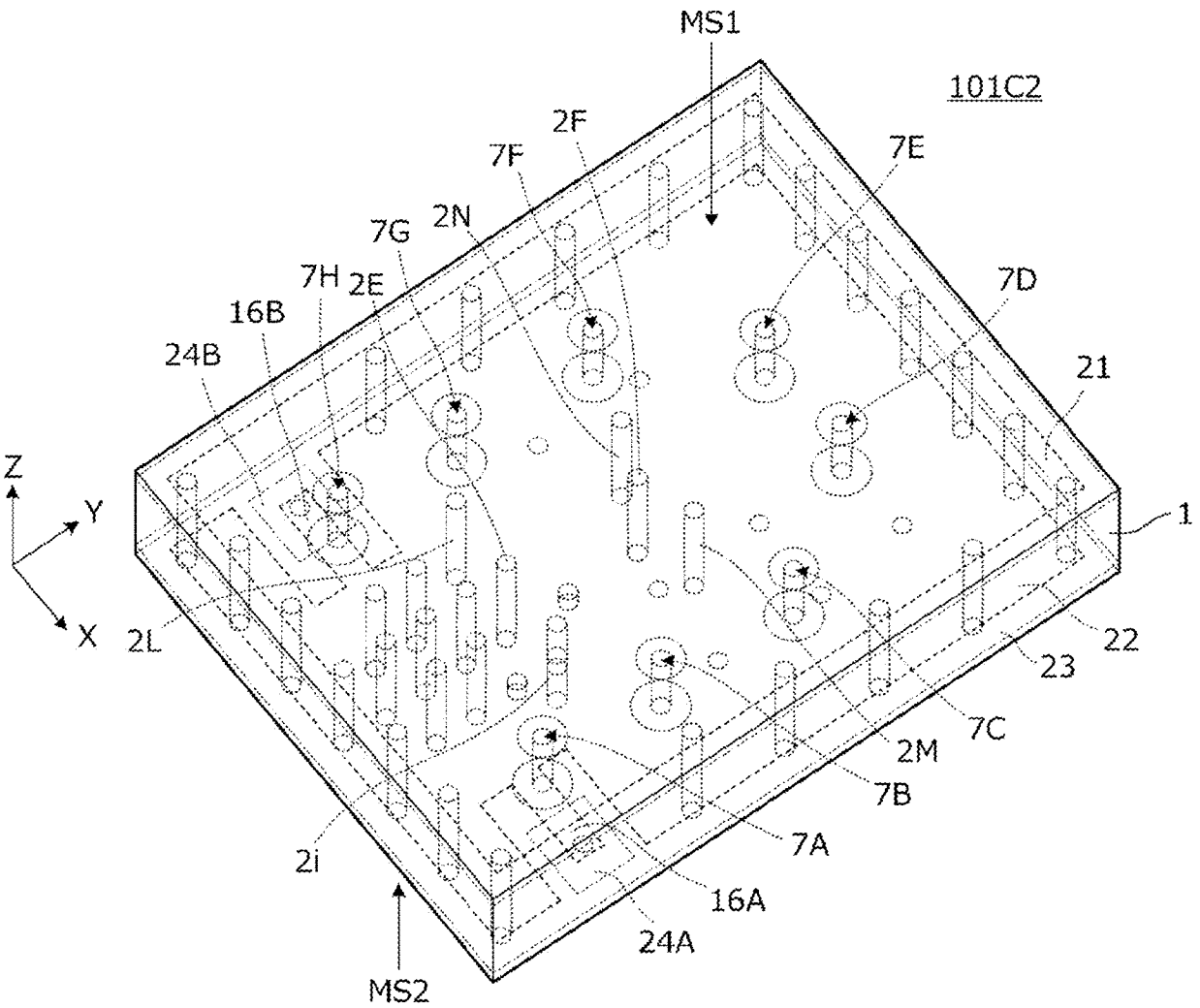
FIG. 14 is a perspective view illustrating an internal structure of a dielectric waveguide filter 101C2 that is a second comparative example.

FIG. 14 is a perspective view illustrating an internal structure of a dielectric waveguide filter 101C2 that is the second comparative example. Unlike the case illustrated in FIG. 1, a dielectric waveguide resonator for a trap resonator is not provided.

Figure 13:
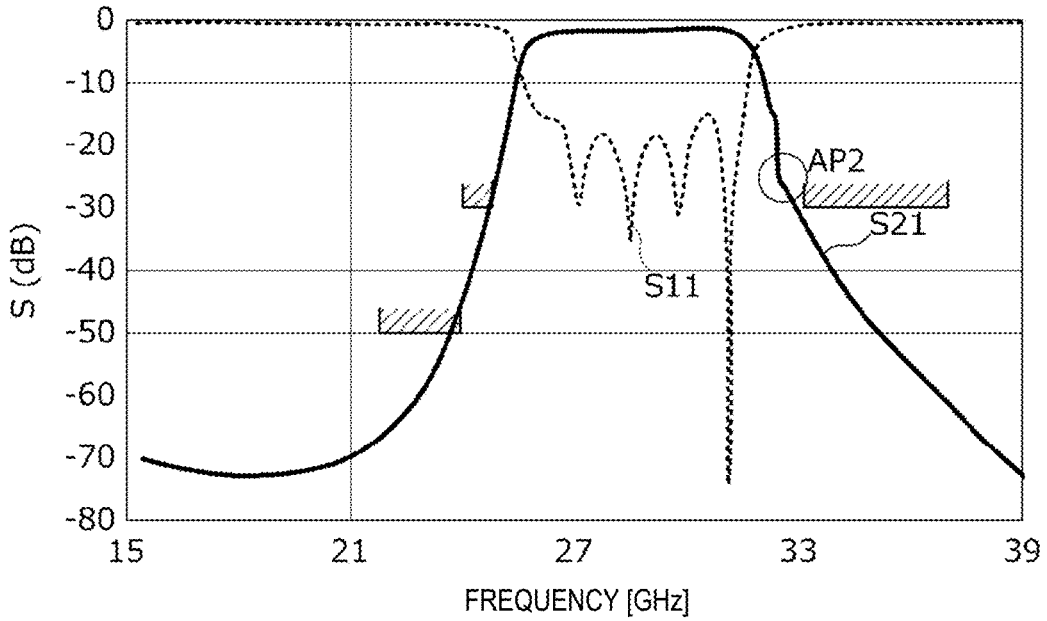
FIG. 13 is a graph illustrating frequency characteristics of a reflection characteristic and a bandpass characteristic of the dielectric waveguide filter 101C1.

FIG. 13 is a graph illustrating frequency characteristics of a reflection characteristic and a bandpass characteristic of the dielectric waveguide filter 101C1. In the dielectric waveguide filter 101C1, which is the first comparative example, as illustrated in FIG. 13, the attenuation pole AP2 is generated in an attenuation band on the higher frequency side of the pass band. This is presumably because the capacitance component generated by the inner conductor 7T became small and the resonant frequency of the dielectric waveguide resonator RT for a trap resonator became high. In other words, it is assumed that the above-mentioned attenuation pole AP2 is generated due to the resonance of the dielectric waveguide resonator RT for a trap resonator.

In the dielectric waveguide filter 101C1, which is the first comparative example, as illustrated in FIG. 13, an attenuation band is not formed (has disappeared) on the lower frequency side of the pass band. It is understood from this that the inner conductor 7T exhibits a phase inversion action on the lower frequency side. In other words, in the case of the dielectric waveguide filter 101C1, which is the first comparative example, the auxiliary coupling portion SC36 illustrated in FIG. 3 does not have capacitive coupling. Thus, the above-mentioned phenomenon in which the phases in the main coupling portions from the third resonator R3 to the sixth resonator R6 and the phase of the auxiliary coupling portion from the third resonator R3 to the sixth resonator R6 are inverted in a frequency range lower than the pass band does not occur. It is assumed from this that the inner conductor 7T contributes to the capacitive coupling between the third resonator R3 and the sixth resonator R6.

Figure 15:
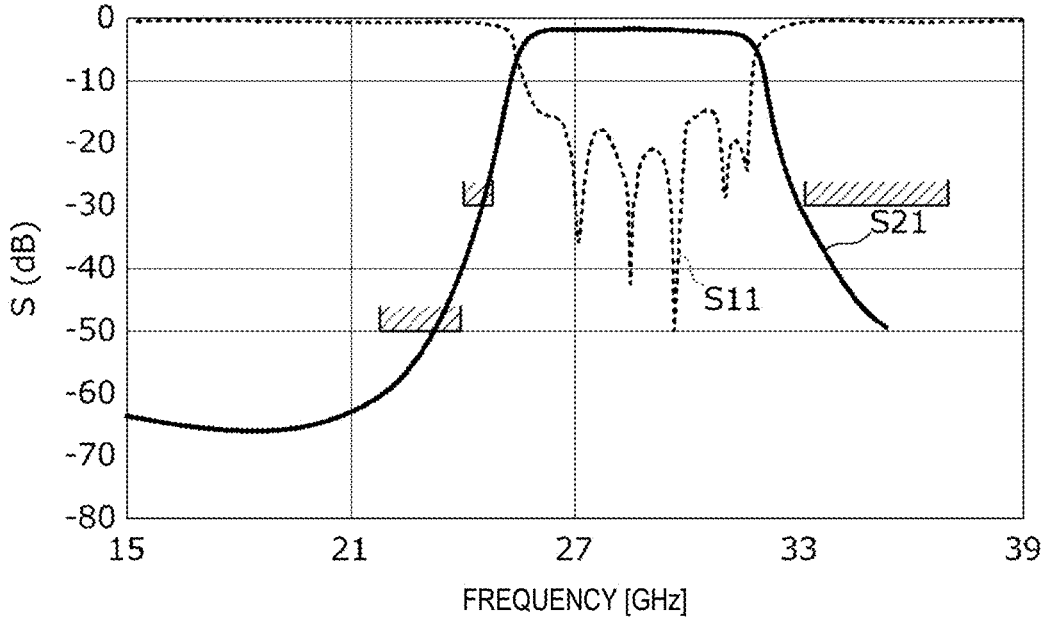
FIG. 15 is a graph illustrating frequency characteristics of a reflection characteristic and a bandpass characteristic of the dielectric waveguide filter 101C2.

FIG. 15 is a graph illustrating frequency characteristics of a reflection characteristic and a bandpass characteristic of the dielectric waveguide filter 101C2, which is the second comparative example. In the dielectric waveguide filter 101C2, which is the second comparative example, an attenuation pole is not generated on either of the low frequency side and the high frequency side of a pass band. This is because the above-mentioned attenuation pole by a trap resonator is not generated and because the capacitive coupling between the third resonator R3 and the sixth resonator R6 by the inner conductor 7T does not occur.

According to the dielectric waveguide filter of the present preferred embodiment, as illustrated in FIG. 6, compared with the above-described dielectric waveguide filter, which is the comparative example, the attenuation pole AP1 is generated on the lower frequency side of the pass band, and the amount of attenuation on the lower frequency side is large. In addition, the attenuation pole AP2 is generated on a slope from the pass band toward the lower frequency side, and steepness from the pass band to the attenuation pole on the lower frequency side is improved.

Figure 7:
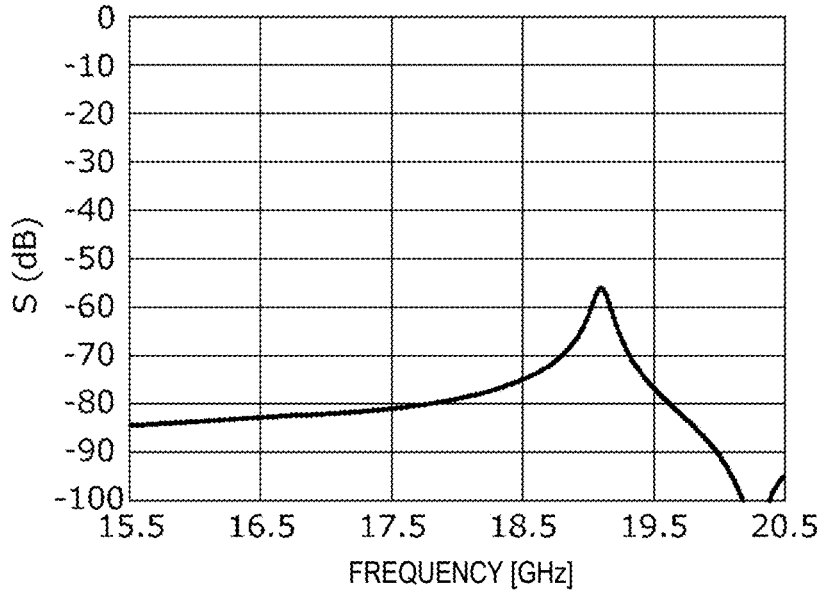
FIG. 7 is a graph illustrating a characteristic that is obtained by a resonance that occurs in an attenuation band on the lower frequency side of a pass band.

FIG. 7 is a graph illustrating a characteristic that is obtained by a resonance that occurs in an attenuation band on the lower frequency side of a pass band. In this case, a resonance peak appears at about 19 GHz, for example. This is presumed to be a response due to unwanted resonance that occurs at a coupling portion of capacitive coupling, and its peak satisfies the characteristic of about −50 dB or less.

Figure 8:
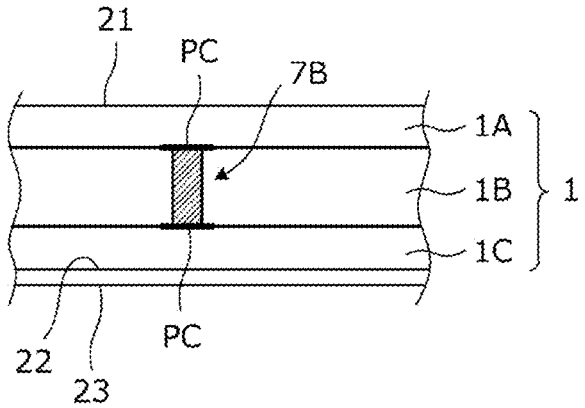
FIG. 8 is a partial sectional view of the dielectric waveguide filter 101 taken at a position that passes through an inner conductor 7B.

FIG. 8 is a partial sectional view of the dielectric waveguide filter 101 taken at a position that passes through the inner conductor 7B. The dielectric plate 1 is a multilayer body including dielectric layers 1A, 1B, and 1C. The inner conductor 7B is a via conductor in the dielectric layer 1B that has a solid cylindrical shape. The dielectric layer 1A is between the inner conductor 7B and the first surface conductor 21, and the dielectric layer 1C is between the inner conductor 7B and the second surface conductor 22. In other words, the inner conductor 7B is a conductor located in the dielectric layer 1B, which is an inner layer among the plurality of dielectric layers 1A, 1B, and 1C. The dielectric plate 1 includes a multilayer substrate as mentioned above, so that the inner conductor 7B can easily be provided in the dielectric plate 1.

The inner conductor 7B includes a planar conductor PC that faces parallel to the first surface conductor 21 and another planar conductor PC that faces parallel to the second surface conductor 22. Each of the planar conductors PC is, for example, a conductor pattern that is formed of a copper film. By arranging the planar conductors PC in this manner, even if the diameter of the via conductor is small, local capacitances that are generated between the inner conductor 7B and the first surface conductor 21 and between the inner conductor 7B and the second surface conductor can easily be increased. In addition, the above-mentioned capacitance can easily be set to a predetermined value by the areas of the planar conductors PC. Furthermore, the above-mentioned capacitance can be determined by the areas of the planar conductors PC, and thus, it can be set to a predetermined capacitance without being affected by the thickness dimension of the dielectric layer 1B.

The dielectric constant of the dielectric layer 1A between the first surface conductor 21 and the inner conductor 7B and the dielectric constant of the dielectric layer 1C between the second surface conductor 22 and the inner conductor 7B are each higher than the dielectric constant of a dielectric (the dielectric layer 1B) in a different region.

In the dielectric waveguide resonant spaces, a parasitic resonance mode in which an electric field is oriented in a direction along the first surface conductor 21 and the second surface conductor 22 (i.e., a magnetic field rotates in a perpendicular direction with respect to the first surface conductor 21 and the second surface conductor 22 (the Z direction)) may sometimes be generated. A principal portion of an electric field in the parasitic resonance mode passes through the dielectric layer 1B, which is located at the center of the electric field distribution, and thus, even if the dielectric constant of each of the dielectric layers 1A and 1C is high, resonant frequency in the parasitic resonance mode does not greatly decrease. In contrast, an electric field in the TE101 mode is oriented in a perpendicular direction with respect to the first surface conductor 21 and the second surface conductor 22 (the Z direction), and thus, the resonant frequency decreases as the dielectric constant of each of the dielectric layers 1A and 1C becomes higher. In other words, by setting the dielectric constant of each of the dielectric layers 1A and 1C to be higher than the dielectric constant of the dielectric layer 1B, the resonant frequency in the TE101 mode can be effectively separated from the resonant frequency in the parasitic resonance mode. As a result, the influence of parasitic resonance can be avoided.

Each of the other inner conductors 7A to 7H, and 7T is similar to the inner conductor 7B illustrated in FIG. 8.

Figure 9A:
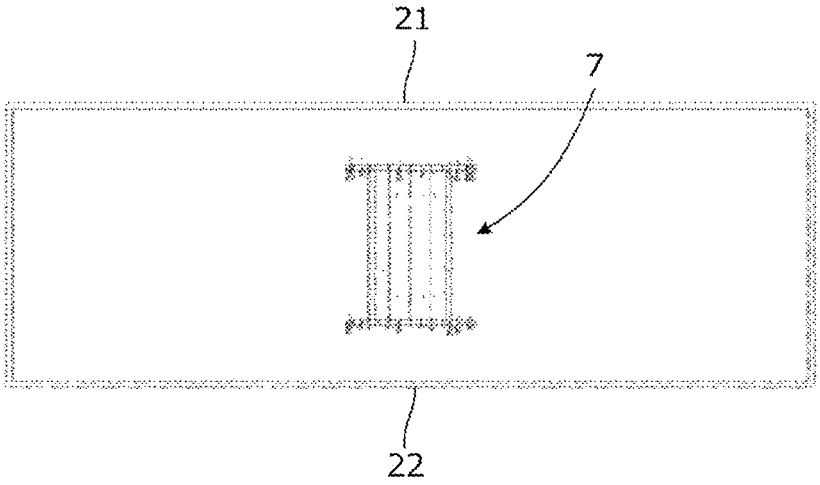
FIGS. 9A and 9B are diagrams each illustrating functions of inner conductors according to the first preferred embodiment of the present invention.
Figure 9B:
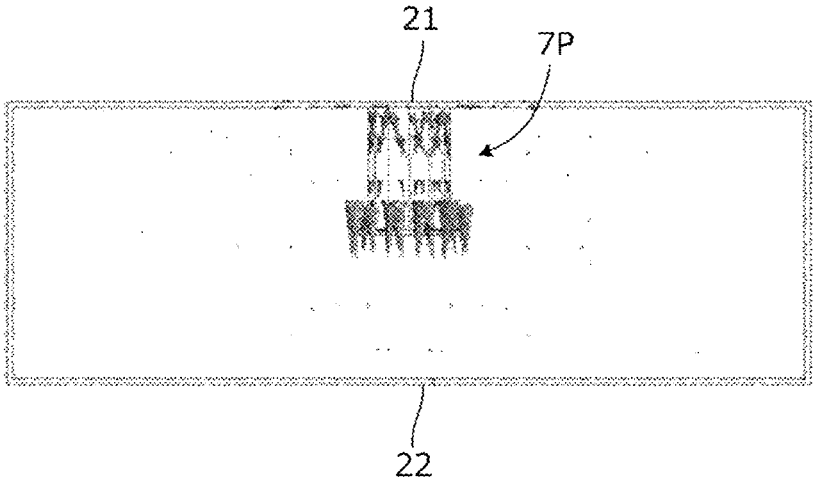

FIGS. 9A and 9B are diagrams each illustrating functions of the inner conductors according to the present preferred embodiment. FIG. 9A is a diagram illustrating distribution of the current density of an inner conductor 7 for a simulation, and FIG. 9B is a diagram illustrating distribution of the current density of a conductor 7P for a simulation as a comparative example. In a dielectric waveguide filter of the comparative example, an end of the conductor 7P is electrically connected to the first surface conductor 21.

According to the present preferred embodiment, the inner conductor 7 is isolated from the first surface conductor 21 and the second surface conductor 22, that is, the inner conductor 7 is deviated from the electric potential of the first surface conductor 21 and the electric potential of the second surface conductor 22 in terms of direct current, and thus, the degree of current concentration in the inner conductor 7 is low (a current concentration portion is dispersed). Thus, a dielectric waveguide resonator including a high Q-value can be obtained.

Here, an example of improvement of the Q value will be described. A dielectric plate used in a simulation is a low-temperature co-fired ceramic (LTCC) including a relative dielectric constant εr of about 8.5. When the first surface conductor 21 and the second surface conductor 22 each have a size of about 1.6 mm×about 1.6 mm and the distance between the first surface conductor 21 and the second surface conductor 22 is set to about 0.55 mm, resonant frequency in the TE101 mode is about 45.4 GHz, and an unloaded Q (hereinafter referred to as "Qo" is about 350. In the case where the conductor 7P of the comparative example, which is illustrated in FIG. 9B, is disposed in this dielectric waveguide resonant space and the resonant frequency is set to 38.6 GHz, the Qo is 320. In contrast, in the case where the inner conductor 7 of the present preferred embodiment, which is illustrated in FIG. 9A, is disposed and the resonant frequency is set to about 38.6 GHz, the Qo is about 349. In other words, compared with the dielectric waveguide resonator including the conductor 7P of the comparative example, the Qo is improved by about 8%. In addition, a decrease in the Qo as a result of providing the inner conductor 7 of the present preferred embodiment is about 0.3%, which is very small.

Second Preferred Embodiment

A dielectric waveguide filter of the second preferred embodiment in which the number of stages of resonators is different from that in the dielectric waveguide filter of the first preferred embodiment will now be described.

Figure 10A:
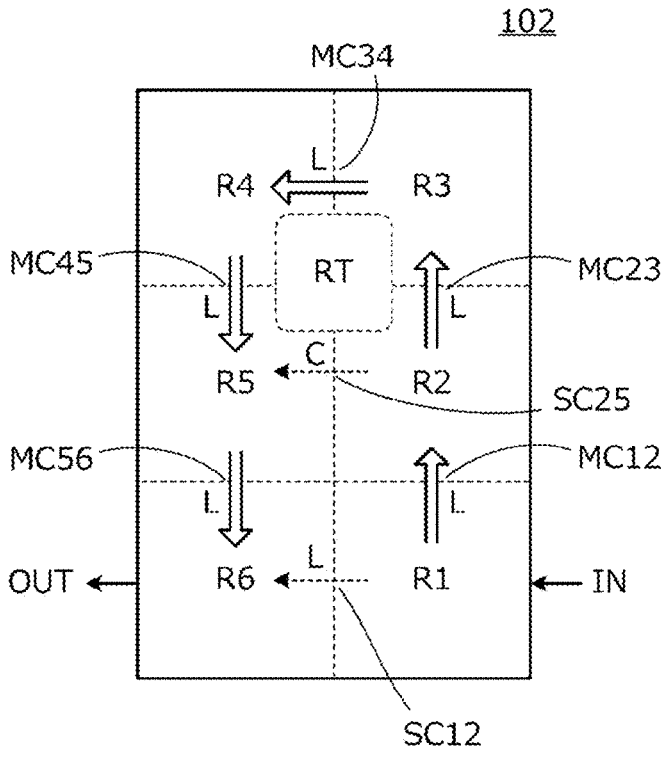
FIGS. 10A and 10B are diagrams illustrating a coupling structure of a plurality of resonators that are included in a dielectric waveguide filter 102 of a second preferred embodiment of the present invention.
Figure 10B:
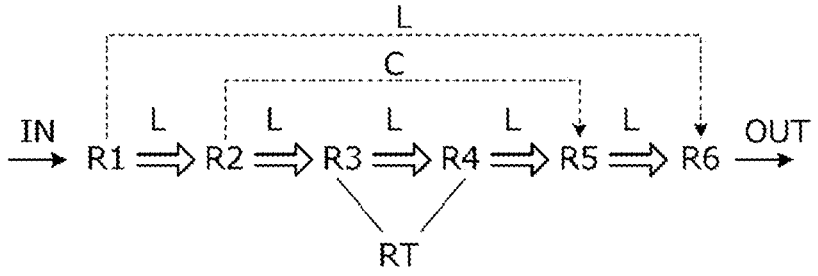

FIGS. 10A and 10B are diagrams illustrating a coupling structure of a plurality of resonators that are included in a dielectric waveguide filter 102 of the second preferred embodiment. In FIGS. 10A and 10B, the resonator R1 is the first stage (the initial stage) resonator. The resonator R2 is the second stage resonator. The resonator R3 is the third stage resonator. The resonator R4 is the fourth stage resonator. The resonator R5 is the fifth stage resonator. The resonator R6 is the sixth stage (the final stage) resonator. In FIGS. 10A and 10B, paths that are indicated by double lines are the main coupling portions, and dashed lines indicate the auxiliary coupling portions. In addition, in FIGS. 10A and 10B, the letter "L" denotes inductive coupling, and the letter "C" denotes capacitive coupling.

In the dielectric waveguide filter 102 of the present preferred embodiment, the resonators R1, R2, R3, R4, R5, and R6 and the main coupling portion MC12, MC23, MC34, MC45, and MC56 are arranged along a main path of signal propagation. Each of the main coupling portion MC12, MC23, MC34, MC45, and MC56 is an inductive coupling portion. In addition, an auxiliary coupling portion SC12 is an inductive coupling portion, and an auxiliary coupling portion SC25 is a capacitive coupling portion. The couplings of the auxiliary coupling portions SC12 and SC25 are weaker than the coupling of each of the main coupling portion MC12, MC23, MC34, MC45, and MC56.

It can be said that the dielectric waveguide filter 102 of the present preferred embodiment may be formed by removing the resonator R1 in the initial stage and the resonator R8 in the final stage of the dielectric waveguide filter 101 of the first preferred embodiment and setting the number of stages of resonators arranged along the main path to six stages. As described above, also the dielectric waveguide filter including six stages can obtain characteristics similar to those of the first preferred embodiment by providing the trap resonator RT.

Third Preferred Embodiment

In the third preferred embodiment, an example of a cellular phone base station to which a dielectric waveguide filter is applied will be described.

Figure 11:
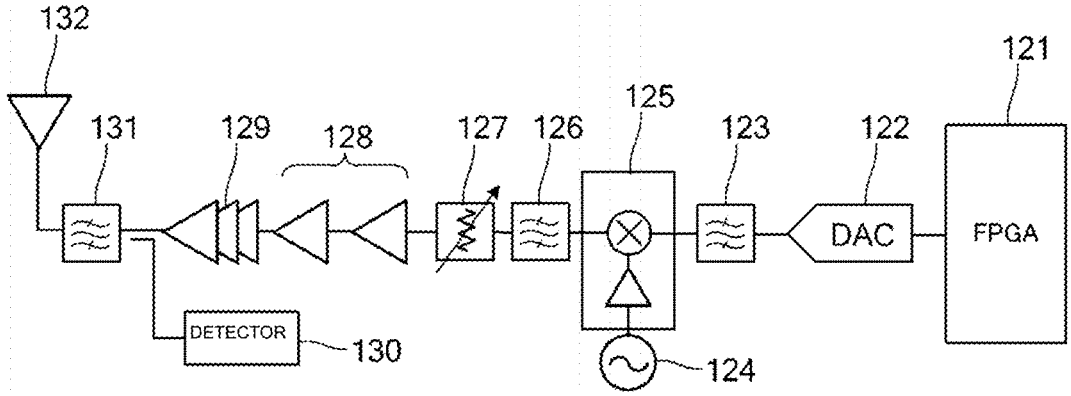
FIG. 11 is a block diagram of a cellular phone base station.

FIG. 11 is a block diagram of a cellular phone base station. A circuit of the cellular phone base station includes an FPGA 121, a DA converter 122, band-pass filters 123, 126, and 131, a single mixer 125, a local oscillator 124, an attenuator 127, an amplifier 128, a power amplifier 129, a detector 130, and an antenna 132.

The above-mentioned FPGA 121 generates a modulated digital signal. The DA converter 122 converts the modulated digital signal into an analog signal. The band-pass filter 123 passes signals in a baseband and removes signals in the other frequency bands. The single mixer 125 mixes and up-converts an output signal of the band-pass filter 123 and an oscillation signal of the local oscillator 124. The band-pass filter 126 removes an unwanted frequency band that is generated as a result of the up-conversion. The attenuator 127 adjusts the intensity of a transmission wave, and the amplifier 128 amplifies in the preceding stage the transmission wave. The power amplifier 129 power-amplifies the transmission wave, and the transmission wave is transmitted from the antenna 132 through the band-pass filter 131. The band-pass filter 131 passes transmission waves in a transmission frequency band. The detector 130 detects transmission power.

In such a cellular phone base station, the dielectric waveguide filter of the first preferred embodiment or the dielectric waveguide filter of the second preferred embodiment can be used as each of the band-pass filters 126 and 131 that pass the frequency band of a transmission wave.

Lastly, the descriptions of the above preferred embodiments are examples in all respects, and the present invention is not to be considered limited to the preferred embodiments. Modifications and changes can be suitably made by those skilled in the art. The scope of the present invention is to be determined not by the above-described preferred embodiments, but by the claims. In addition, changes within the scope of the claims and their equivalents made to the preferred embodiments are included in the scope of the present invention.

For example, in the above-described cases, although each of the inner conductors is a via conductor that has a solid cylindrical shape, each of the inner conductors may be, for example, a tubular via conductor that has a hollow cylindrical shape or the like.

In addition, although a case where all the dielectric waveguide resonators in the dielectric waveguide filter include the inner conductors is illustrated in FIG. 1 and the like, the dielectric waveguide filter may include a dielectric waveguide resonator that does not include an inner conductor.

Furthermore, although a case where the through-via conductors 9A to 9V connecting the first surface conductor 21 and the second surface conductor 22 to each other form a "connection conductor" is illustrated in FIG. 1 and the like, the "connection conductor" may be formed by forming a conductor film in or on a side surface of a dielectric plate.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A dielectric waveguide filter comprising:

a plurality of dielectric waveguide resonators each of which includes a dielectric plate including a first main surface, a second main surface, and a side surface, the first main surface and the second main surface opposing each other, and the side surface connecting an outer edge of the first main surface and an outer edge of the second main surface to each other, a first surface conductor in or on the first main surface, a second surface conductor in or on the second main surface, and a connection conductor in the dielectric plate and connecting the first surface conductor and the second surface conductor to each other;

a main coupling portion between dielectric waveguide resonators that are adjacent to each other along a main path of signal propagation; and an auxiliary coupling portion between dielectric waveguide resonators adjacent to each other along an auxiliary path of signal propagation; wherein some or all of the plurality of dielectric waveguide resonators each include an inner conductor extending in a direction perpendicular to the first main surface;

the plurality of dielectric waveguide resonators include a first set of dielectric waveguide resonators including three or more dielectric waveguide resonators, a second set of dielectric waveguide resonators including three or more dielectric waveguide resonators, and a dielectric waveguide resonator for a trap resonator that includes the inner conductor;

the main coupling portion is between the dielectric waveguide resonator in a final stage of the first set and the dielectric waveguide resonator in an initial stage of the second set;

the dielectric waveguide resonator for a trap resonator is between the dielectric waveguide resonator that is one stage before the dielectric waveguide resonator in the final stage of the first set and the dielectric waveguide resonator that is one stage after the dielectric waveguide resonator in the initial stage of the second set; and the dielectric waveguide resonator for a trap resonator is a dielectric waveguide resonator that is coupled to the dielectric waveguide resonator in the final stage of the first set and the dielectric waveguide resonator in the initial stage of the second set.

2. The dielectric waveguide filter according to claim 1, wherein the inner conductor included in the dielectric waveguide resonator for a trap resonator defines a capacitive coupling portion between the dielectric waveguide resonator that is one stage before the dielectric waveguide resonator in the final stage of the first set and the dielectric waveguide resonator that is one stage after the dielectric waveguide resonator in the initial stage of the second set.

3. The dielectric waveguide filter according to claim 1, wherein a distance between the inner conductor of the dielectric waveguide resonator in the final stage of the first set and the inner conductor of the dielectric waveguide resonator in the initial stage of the second set is smaller than a distance between the inner conductor of the dielectric waveguide resonator that is one stage before the dielectric waveguide resonator in the final stage of the first set and the inner conductor of the dielectric waveguide resonator that is one stage after the dielectric waveguide resonator in the initial stage of the second set.

4. The dielectric waveguide filter according to claim 3, wherein a distance between the inner conductor of the dielectric waveguide resonator in the final stage of the first set and the inner conductor for the trap resonator is equal to a distance between the inner conductor of the dielectric waveguide resonator in the initial stage of the second set and the inner conductor for the trap resonator.

5. The dielectric waveguide filter according to claim 1, wherein the auxiliary coupling portion is between the dielectric waveguide resonator that is two stages before the dielectric waveguide resonator in the final stage of the first set and the dielectric waveguide resonator that is two stages after the dielectric waveguide resonator in the initial stage of the second set, and the auxiliary coupling portion is an inductive auxiliary coupling portion.

6. The dielectric waveguide filter according to claim 1, wherein a main resonant mode of the dielectric waveguide resonators is a TE mode in which an electric field is oriented between the first surface conductor and the second surface conductor.

7. The dielectric waveguide filter according to claim 1, wherein the connection conductor is a conductor film in or on a side surface of the dielectric plate or a through-via conductor extending through the dielectric plate.

8. The dielectric waveguide filter according to claim 1, wherein the inner conductors are not electrically connected to either of the first surface conductor and the second surface conductor.

9. The dielectric waveguide filter according to claim 8, wherein a dielectric is provided between the inner conductors and the first surface conductor and between the inner conductors and the second surface conductor.

10. The dielectric waveguide filter according to claim 8, wherein a space is provided inside the dielectric plate, and each of the inner conductors is a conductor injected in the space or a conductor in or on an inner surface of the space.

11. The dielectric waveguide filter according to claim 8, wherein each of the inner conductors is a solid cylindrical or hollow cylindrical conductor.

12. The dielectric waveguide filter according to claim 8, wherein each of the inner conductors includes at least one of a planar conductor that faces parallel to the first surface conductor or a planar conductor that faces parallel to the second surface conductor.

13. The dielectric waveguide filter according to claim 8, wherein a dielectric constant of a dielectric that is provided in at least one of a region between the first surface conductor and the inner conductors and a region between the second surface conductor and the inner conductors is higher than a dielectric constant of a dielectric in a different region.

14. A dielectric waveguide filter comprising:

a plurality of dielectric waveguide resonators each of which includes a dielectric plate including a first main surface, a second main surface, and a side surface, the first main surface and the second main surface opposing each other, and the side surface connecting an outer edge of the first main surface and an outer edge of the second main surface to each other, a first surface conductor in or on the first main surface, a second surface conductor in or on the second main surface, and a connection conductor in the dielectric plate and connecting the first surface conductor and the second surface conductor to each other;

a main coupling portion between dielectric waveguide resonators that are adjacent to each other along a main path of signal propagation; and an auxiliary coupling portion between dielectric waveguide resonators that are adjacent to each other along an auxiliary path of signal propagation;

some or all of the plurality of dielectric waveguide resonators each include an inner conductor extending in a direction perpendicular to the first main surface;

the plurality of dielectric waveguide resonators include a first set of dielectric waveguide resonators including three or more dielectric waveguide resonators, a second set of dielectric waveguide resonators including three or more dielectric waveguide resonators, and a dielectric waveguide resonator for a trap resonator that includes the inner conductor;

the main coupling portion is between the dielectric waveguide resonator in a final stage of the first set and the dielectric waveguide resonator in an initial stage of the second set;

the dielectric waveguide resonator for a trap resonator is at a position surrounded by the inner conductor of the dielectric waveguide resonator in the final stage of the first set, the inner conductor of the dielectric waveguide resonator in the initial stage of the second set, the inner conductor of the dielectric waveguide resonator that is one stage before the dielectric waveguide resonator in the final stage of the first set, and the inner conductor of the dielectric waveguide resonator that is one stage after the dielectric waveguide resonator in the initial stage of the second set; and the dielectric waveguide resonator for a trap resonator is a dielectric waveguide resonator that is coupled to the dielectric waveguide resonator in the final stage of the first set and the dielectric waveguide resonator in the initial stage of the second set.

15. The dielectric waveguide filter according to claim 14, wherein the inner conductor included in the dielectric waveguide resonator for a trap resonator defines a capacitive coupling portion between the dielectric waveguide resonator that is one stage before the dielectric waveguide resonator in the final stage of the first set and the dielectric waveguide resonator that is one stage after the dielectric waveguide resonator in the initial stage of the second set.

16. The dielectric waveguide filter according to claim 14, wherein a distance between the inner conductor of the dielectric waveguide resonator in the final stage of the first set and the inner conductor of the dielectric waveguide resonator in the initial stage of the second set is smaller than a distance between the inner conductor of the dielectric waveguide resonator that is one stage before the dielectric waveguide resonator in the final stage of the first set and the inner conductor of the dielectric waveguide resonator that is one stage after the dielectric waveguide resonator in the initial stage of the second set.

17. The dielectric waveguide filter according to claim 16, wherein a distance between the inner conductor of the dielectric waveguide resonator in the final stage of the first set and the inner conductor for the trap resonator is equal to a distance between the inner conductor of the dielectric waveguide resonator in the initial stage of the second set and the inner conductor for the trap resonator.

18. The dielectric waveguide filter according to claim 14, wherein the auxiliary coupling portion is between the dielectric waveguide resonator that is two stages before the dielectric waveguide resonator in the final stage of the first set and the dielectric waveguide resonator that is two stages after the dielectric waveguide resonator in the initial stage of the second set, and the auxiliary coupling portion is an inductive auxiliary coupling portion.

19. The dielectric waveguide filter according to claim 14, wherein a main resonant mode of the dielectric waveguide resonators is a TE mode in which an electric field is oriented between the first surface conductor and the second surface conductor.

20. The dielectric waveguide filter according to claim 14, wherein the connection conductor is a conductor film in or on a side surface of the dielectric plate or a through-via conductor extending through the dielectric plate.

21. The dielectric waveguide filter according to claim 14, wherein the inner conductors are not electrically connected to either of the first surface conductor and the second surface conductor.

22. The dielectric waveguide filter according to claim 21, wherein a dielectric is provided between the inner conductors and the first surface conductor and between the inner conductors and the second surface conductor.

23. The dielectric waveguide filter according to claim 21, wherein a space is provided inside the dielectric plate, and each of the inner conductors is a conductor injected in the space or a conductor in or on an inner surface of the space.

24. The dielectric waveguide filter according to claim 21, wherein each of the inner conductors is a solid cylindrical or hollow cylindrical conductor.

25. The dielectric waveguide filter according to claim 21, wherein each of the inner conductors includes at least one of a planar conductor that faces parallel to the first surface conductor or a planar conductor that faces parallel to the second surface conductor.

26. The dielectric waveguide filter according to claim 21, wherein a dielectric constant of a dielectric that is provided in at least one of a region between the first surface conductor and the inner conductors and a region between the second surface conductor and the inner conductors is higher than a dielectric constant of a dielectric in a different region.

* * * * *